US005992073A

United States Patent [19]

Wolpa

[11] Patent Number: 5,992,073

[45] Date of Patent: Nov. 30, 1999

[54] CONTENTS IDENTIFICATION DEVICE FOR A CONTAINER

[76] Inventor: Ronald B. Wolpa, 6 Pinewood, Irvine, Calif. 92604

[21] Appl. No.: 08/937,404

[22] Filed: Sep. 25, 1997

[51] Int. Cl.[6] ..... G09F 3/20

[52] U.S. Cl. ..... 40/651; 40/649; 40/306; 40/488

[58] Field of Search ..... 40/651, 306, 310, 40/312, 649, 665, 633, 630, 488, 489, 490, 491

[56] References Cited

U.S. PATENT DOCUMENTS

| | | | |
|---|---|---|---|
| 337,713 | 3/1886 | Snypp | 40/651 X |
| 1,403,100 | 1/1922 | Osburn | 40/651 |
| 1,430,207 | 9/1922 | Woodhouse | 40/651 |
| 1,497,388 | 6/1924 | Sterling | 40/306 X |
| 1,649,442 | 11/1927 | Bredemeier . | |
| 1,761,995 | 7/1930 | Siebe | 40/651 |
| 2,565,095 | 8/1951 | Schatzkin | 40/310 X |
| 2,625,131 | 1/1953 | Sturhahn | 40/310 |
| 2,771,854 | 11/1956 | Cronenwett | 40/310 X |
| 2,844,893 | 7/1958 | Keller | 40/4 |
| 3,494,059 | 2/1970 | Minasian | 40/306 |
| 3,803,738 | 4/1974 | Weiss | 40/306 |
| 4,534,391 | 8/1985 | Ventimiglia et al. | 150/52 |
| 4,860,684 | 8/1989 | Al-Harbi | 40/310 X |
| 4,877,119 | 10/1989 | Hosking | 206/459 |
| 5,575,096 | 11/1996 | Allegre | 40/306 |

*Primary Examiner*—Michael F. Trettel
*Assistant Examiner*—Fredrick Conley
*Attorney, Agent, or Firm*—Gene Scott-Patent Law & Venture Group

[57] ABSTRACT

The present invention provides an identification device, and a method of use therefor. The identification device comprises a label holder, at least one label, and a strap or adhesive bond to secure the label holder to a storage container. The label holder preferably has a box frame and a slot therein. A slot entrance aperture allows the insertion of the label or labels into the slot. A window in an exterior wall of the label holder provides visual access to at least a portion of the information on the label. Each of the labels has a tab extending outwardly from the slot entrance aperture as well as printed information on at least one side of the label concerning the age of, the nature of, and the approximate amount of the contents of the storage container. In its preferred mode, the identification device also includes an indicator. The indicator preferably is attached to the box frame by an oval shaft that fits into a hole with a plurality of detents. The indicator is positionable at each one of a plurality of orientations to represent varying approximate levels of the contents as indicated on the label.

8 Claims, 2 Drawing Sheets

CONTENTS IDENTIFICATION DEVICE FOR A CONTAINER

BACKGROUND OF THE INVENTION

1. Field of the Invention

This invention relates generally to container labels, and more particularly to a label holder capable of attachment to a container and of identifying various properties of the contents within a storage container.

2. Description of Related Art

Containers are used for storage of foodstuffs, hardware, clothing, and a wide range of products. Many containers are disposed of when the contents are used up. Other storage containers are reused and refilled. It is often desirable to know what is stored in a given container and how much of the contents is left in the container, assuming that the contents are used-up at a slow rate, as in breakfast cereal, flour, sugar and other foodstuff commodities. Many containers are available commercially for storage of foodstuffs. Paper and plastic sacks, cans, jars, and glassware are all available for holding and storing such products. These containers however, suffer from the common fault of being difficult to use in that they do not allow one to know the nature of the contents and how much is left in the container without opening the container and inspecting it, and visual inspection may not provide enough information. This is problematic in itself in that opening the container allows air and moisture to enter the container and may hasten spoilage.

An example of this is when a gourmet coffee drinker has several containers of different blends of coffee—they all look very similar if not identical. For instance, it is not possible to tell what blend of coffee is inside a container, or whether it is decaffeinated, and when it was purchased. This kind of information is obviously quite important to many products especially for foods.

The following art defines the present state of this field:

Bredemeier, U.S. Pat. No. 1,649,442 describes a means of labeling containers. It is the object of the invention to enable a housekeeper to utilize containers, such for example as those in which coffee is packed and sold to the consumer, as jars or receptacles for a variety of food products, and to conveniently affix various labels to such containers on defined spaces on the exterior of the same so that a plurality of such containers may be accumulated by a housekeeper for storing various kinds of foods in a neat, orderly and attractive manner.

Keller, U.S. Pat. No. 2,844,893 describes containers such as bottles or prescription vials commonly used by pharmacists to contain prescribed medicines and where it is necessary to individually label each bottle. The object is to provide a container to which the label may be attached without glue and wherein the label is covered by a transparent protective member.

Weiss, U.S. Pat. No. 3,803,738 describes a readily attachable and changeable outdoor advertising sign and a complemental relatively stationary but portable support therefor. The sign comprises a metal picture-type frame. The inner perimeter surfaces of the frame members are E-shaped and provide inward and outward searing channels. The outward channel portions receive and retain the gasket-equipped sealing and weatherproofing edges of a transparent window while the inward channel portions sear and removably retain the marginal edges of a changeable sign, an attractive display-type placard. This composite eye appealing sign is removable but retentively housed and keyed in track portions of a receiver, more particularly, an oriented and coordinating receiver which is recessed in a vertical wall portion of a decorative-type outdoors support, more particularly, a solid waste container or receptacle. This receptacle is preferably of a type which lends itself to litter collecting use on city streets, in keeping with environmental services recommendations.

Ventimiglia et al., U.S. Pat. No. 4,534,391 describes a one-piece plastic insulated beverage receptacle holder having longitudinal side panels, one of which is wider than the remainder and recessed to accommodate ad copy or the like.

Hosking, U.S. Pat. No. 4,877,119 describes an improved drinking-beaker assembly which serves as both a drinking vessel, especially the drinking of water in the course of a diet, and a device for determining the precise amount of liquid consumed. The assembly preferably includes a beaker, a snap-ring collar, indicia for the number of uses and indicia for the volume level within the beaker. The beaker has a base, a wall and an open top. Portions of the wall define an annular groove having an upper rib, a bright and a lower rib. The collar is snugly fitted within the groove for manual, axial rotation of the collar relative to the beaker. The collar further includes a window which is aligned with the use indicia to sequentially indicate the number of consumptive uses of the assembly. The user may fill the beaker to the level of the volume indicia, consume the liquid from the beaker and then rotate the collar with respect to the beaker so that the window exclusively displays Allegre, U.S. Pat. No. 5,575,096 describes a sleeve for placement around a container that utilizes a single continuous sheet of plastic which is folded into an enclosed shape having a front side, a back side and an overlapping section extending over the front side to form a sleeve body. This enclosed shape is held together by welds formed through adjacent edges of the front and back sides and the overlapping section. At least one precut is formed in the overlapping section. This precut extends parallel to the welds to allow for detachment of a portion of the overlapping section such that the front side is visible. Information can be printed both on the overlapping section and on the front and back sides, so that the sleeve of the invention has a larger surface area for printing than conventional sleeves which include only front and back portions.

In the prior art, additional information about the product is usually written on a plain adhesive label which is applied to the storage container. However, in a storage container that is used again and again for different products or event the same product but with different storage dates, this method is not only inflexible, it is also not visually pleasing, i.e., with label removal remnants, plural label stacking and so on.

The prior art teaches transparent as well as non-transparent containers and adhesive labels. However, the prior art does not teach an apparatus that provides all of the required information about the contents of the container in a visually pleasing fashion. The prior art also does not provide an easy way to change the information to reflect the amount of contents left in the storage container and the nature of the contents when, for instance, a new blend of coffee is being tried. The present invention fulfills these needs and provides further related advantages as described in the following summary.

SUMMARY OF THE INVENTION

The present invention teaches certain benefits in construction and use which give rise to the objectives described below.

The present invention provides an identification device, and a method of use therefor. The identification device comprises a label holder capable of removably supporting multiple labels, and an attachment means such as a strap or adhesive bond to secure the label holder to the storage container. The label holder preferably has a box frame and a slot therein. A slot entrance aperture allows the insertion of one or more label means into the slot. A window in an exterior wall of the label holder provides visual access to at least a portion of the information on the label. The label means has a tab means extending outwardly from the slot entrance aperture, the tab means providing further information about the container's contents. The label means also has printed information on at least one side of the label means concerning the age of, the nature of, and the approximate amount of the contents (not shown) of the storage container. In its preferred mode, the identification device also includes an indicator. The indicator preferably is attached to the box frame and is positionable at any one of a plurality of orientations to represent varying approximate levels of the contents so as to indicate how much of the contents remains within the container.

A primary objective of the present invention is to provide readily viewable and easily changeable labels containing various printed and graphical information about the contents of the storage container having advantages not taught by the prior art. Specifically, this invention allows purchasers of specialty coffees to keep track of the type of coffee being stored, whether that coffee is decaffeinated or not, and when the coffee was purchased. This allows drinkers of specialty coffees to store many different blends of coffee in different reusable containers without forgetting which coffee blend is in which container. The reverse side of the tabs can contain additional information such as various types of coffee available, the consumer's preferred blends, and various purchasing information.

Another objective is to provide the necessary information in a visually pleasing manner, without the use of adhesives or transparent containers.

Another objective is to provide an indicator so the user can readily tell whether the container is full or nearly empty, etc., without having to open the container to view the contents.

A further objective is to provide the information on tabs which are independent of the device itself, thus allowing the tabs to be independently purchased with the materials which are to be stored in the storage containers, as well as allowing the tabs to be placed in a pocket to remind the consumer that it is necessary to purchase more of the stored goods when the container is nearly empty.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
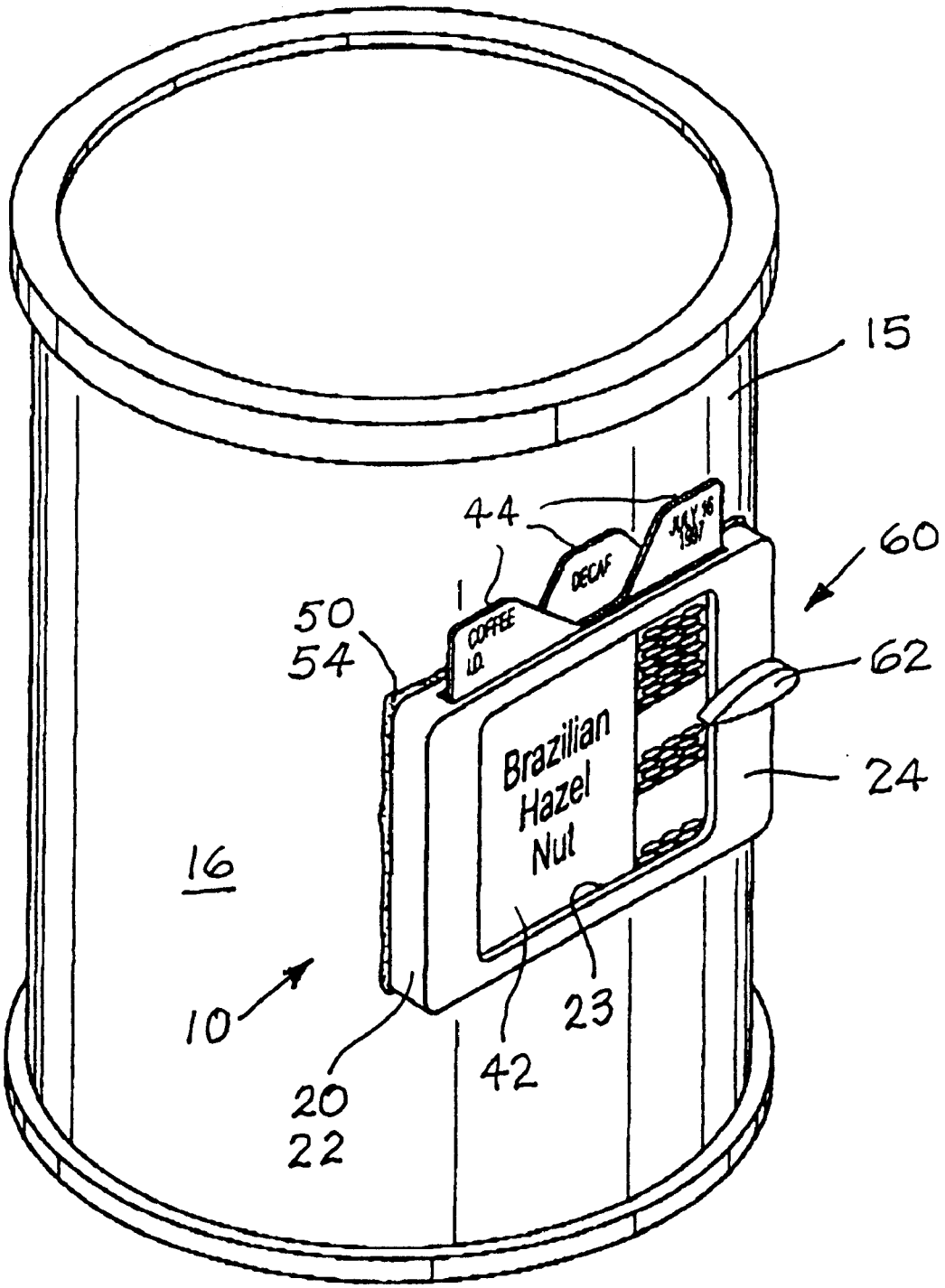
FIG. 1 is a perspective view of the preferred embodiment of the present invention shown attached to a storage container with an adhesive bonding means.

The above described drawing figures illustrate the invention, an identification device 10 for identifying the nature of, and approximate level of, a contents (not shown) within a storage container 15 having an exterior surface 16. The identification device 10 has a label holder 20, a label engagement means 30, a label means 40, and an attachment means 50 of the label holder 20 to an exterior surface 16 of the storage container 15.

Figure 2:
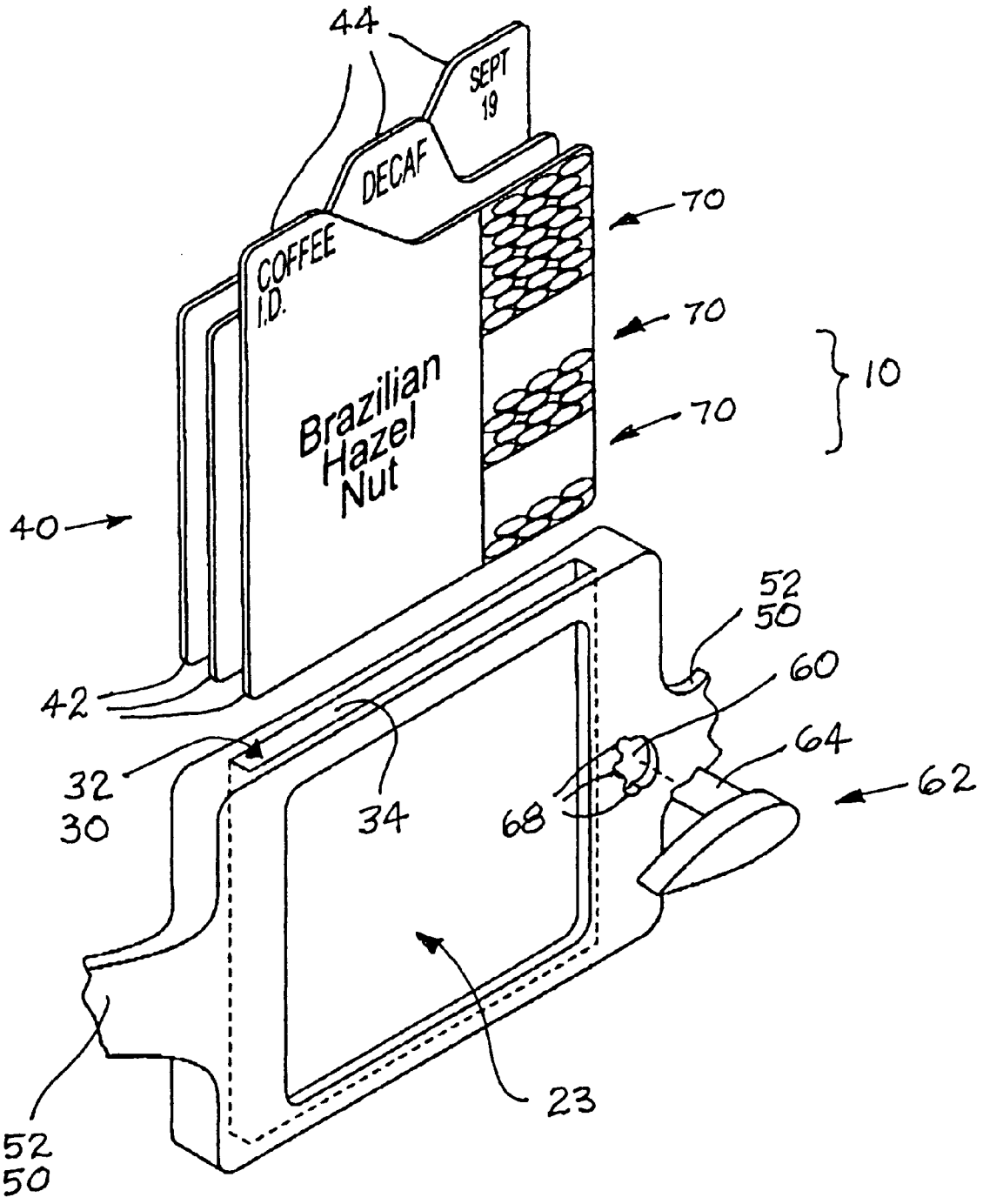
FIG. 2 is an exploded view of the invention with a partial view of a strap used as an attachment means for encircling the storage container.

As shown in FIGS. 1 and 2, in its preferred embodiment the label holder 20 is a box frame 22 and the label engagement means 30 is a slot 32 therein. A slot entrance aperture 34 provides a means for inserting the label means 40 into the slot 32. A window 23 in an exterior wall 24 of the label holder 20 provides visual access to at least a portion of the information on the label means 40. The label holder 20 is preferably made of plastic and the window 23 is preferably an open space or a transparent material.

The label means 40 is preferably a laminated card 42 with colorful text and graphics printed thereon. The label means 40 preferably provides information such as the age of, the nature of, and the approximate amount of the contents (not shown) of the storage container 15. The label means 40 preferably further includes a tab means 44 extending outwardly from the slot entrance aperture 34, the tab means 44 providing indicia appropriate to the contents of the container. The label means 40 is not limited to a single laminated card 42; but preferably includes a plurality of separate laminated cards 42; and the slot 32 is sufficiently wide enough to accept a plurality of the laminated cards 42. For instance, when the contents of the container 15 is coffee, the label means 40 provides written and graphical information about the type of coffee within the container 15, the coffee's date of first storage, and caffeination information. This meets one of the objects of the invention, by providing a professionally printed laminated card 42 which is visually pleasing but can be changed to reflect whatever contents are placed into the storage container 15.

The identification device 10 is attached to the storage container 15 with an attachment means 50, preferably either a strap 52 attached to the box frame 22 and encompassing the storage container as shown in FIG. 2, or an adhesive bonding means 54 securing the identification device 10 to the exterior surface 16 of the storage container 15 by adhesion, as shown in FIG. 1. To make it easy for the consumer, double sided tape can be used as an adhesive bonding means 54. The strap 52 has the benefit of being easily removable from the storage container 15 without any residual adhesive, and is preferably made of an elastic material which wraps around the storage container 15 and attaches to itself with hook and loop attachment material such as Velcro® (not shown). The attachment strap 52 may be secured to the container 15, however, by any one of a wide range of attachment means as are well known in the art.

The identification device 10 preferably also includes an approximate level identifying means 60. In one embodiment, the approximate level identifying means 60 has an indicator 62 attached to an oval shaft 64 that fits into a hole 66 in the box frame 22. The hole 66 has a plurality of detents 68 which define a plurality of orientations for the shaft. The oval shaft 64 rotates within the hole 66 such that it is biased into the positions defined by the detents 68, causing the indicator 62 to point in any one of the plurality of orientations as desired and selected. A plurality of pictorial representations 70 or other indicia can then be used to signify varying approximate levels of the contents, with the representations being arranged so as to be selectable by the indicator 62. Another approximate level identifying means 60 comprises an indicator 62 slidably mounted (not shown) on the box frame 22. By sliding the indicator 62 so that it points to the various pictorial representations 70 or other indicia, it is possible to signify varying approximate levels of the contents. Many other arrangements which achieve the same result are well known in the art and can be adapted to this invention, the underlying theme being the use of a mechanical movable indicator to select one or another of a series of pictures on a label card. This approximate level identifying means 60 meets another object of the invention, by providing a mechanism which can easily be changed so it is possible to readily tell whether the storage container 15 is full, half-full or nearly empty without having to open the storage container 15. Furthermore, this is accomplished in a visually pleasing manner, another object of the invention.

The invention further teaches a method of identifying the nature and level of the contents within a storage container 15. A first step, in this method includes attaching the label holder 20 described above to the exterior surface 16 of the storage container 15. As described above, this can be accomplished either by bonding the label holder 20 to the exterior surface 16 or by wrapping the strap 52 around the storage container 15 and fastening the strap 52 to itself with Velcro™, or another suitable fastener. After filling the storage container 15 with the contents to a selected level within the storage container 15, the label means 40 described above is inserted through the slot entrance aperture 34 and into the slot 32 of the label holder 20 so that the label means 40 is visible through a window 23 in the label holder 20. The indicator 62 is then adjusted to indicate one of the pictorial representations 70 corresponding to the actual level of the contents within the storage container 15. After removing a portion of the contents of the storage container 15 for use, the indicator 62 is readjusted to select the pictorial representation 70 which reflects the portion of the contents remaining in the container. This process is continued until the storage container 15 is empty. The label means 40 may then be removed from the holder to serve as a reminder to purchase more of the contents (not shown). Once the purchase is made and after refilling the storage container 15, you reset the indicator 62, reinsert the label means 40, and repeat the process. If the storage container 15 is refilled with different contents, you replace the original label means 40 with a new label means 40 with information corresponding to the new contents.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination storage container, a storage container contents and a storage container contents identification device, the combination comprising:

a label holder providing a means for attachment of the label holder to an exterior surface of an opaque storage container, and a means for removable engagement of a label means within the label holder, said label holder further providing viewing means positioned for freely viewing the label means and a surface indicia thereon, the surface indicia defining a nature and a plurality of selected contents levels of a storage container contents within the storage container;

a contents level identifying means rotationally mounted onto the label holder and providing a moveable indicator, the moveable indicator enabled for incremental positioning at each one of a plurality of positions for indicating, by association, any one of the plurality of contents levels of the surface indicia on the label means.

2. The device of claim 1 wherein the attachment means is a strap encompassing the storage container.

3. The device of claim 1 wherein the attachment means is adhesive bonding of the device to the exterior surface of the storage container.

4. The device of claim 1 wherein the label holder is a box frame, the removable engagement means being a slot therein, a slot entrance aperture providing a means for inserting the label means into the slot, the viewing means comprising a window in an exterior wall of the label holder for providing visual access to at least a portion of the surface indicia.

5. The device of claim 1 wherein the label means further includes a tab means extending outwardly from the slot entrance aperture, the tab means providing indicia appropriate to the contents of the container.

6. The device of claim 5 wherein the label means includes separate label cards, the slot being sufficient for accepting a plurality of the label cards.

7. The device of claim 6 wherein the contents of the container is coffee and the label means provides written and graphical information about the type of coffee within the container, including the date of purchase of the coffee and caffeination information thereof.

8. The device of claim 6 wherein the tab means comprises individual tabs associated with the label cards, the label cards being arrangeable within the slot so that the tabs are spaced apart.

* * * * *